United States Patent [19]

Barnicoat

[11] Patent Number: 5,070,973

[45] Date of Patent: Dec. 10, 1991

[54] CONTAINERS, E.G. BEACH BAGS

[76] Inventor: David J. Barnicoat, 18B Kool Baai Villas, Cole Bay, St. Maarten, Netherlands Antilles

[21] Appl. No.: 488,003

[22] PCT Filed: Nov. 14, 1988

[86] PCT No.: PCT/GB88/00990

§ 371 Date: May 31, 1990

§ 102(e) Date: May 31, 1990

[87] PCT Pub. No.: WO89/04618

PCT Pub. Date: Jun. 1, 1989

[30] Foreign Application Priority Data

Nov. 13, 1987 [GB] United Kingdom ..... 8726574

[51] Int. Cl.[5] ..... A45C 3/10; A45C 9/00

[52] U.S. Cl. ..... 190/8; 5/417; 383/4

[58] Field of Search ..... 190/1, 8; 5/417–420; 383/4; 297/377

[56] References Cited

U.S. PATENT DOCUMENTS

| | | | |
|---|---|---|---|
| 1,930,492 | 10/1933 | Pringle | 5/419 |
| 2,034,369 | 1/1936 | Bayer | 190/1 X |
| 2,047,035 | 7/1936 | Rosenberg | 190/1 |
| 2,070,484 | 2/1937 | Jones | 190/1 X |
| 2,543,597 | 2/1951 | Peery | 5/418 X |
| 2,738,249 | 3/1956 | Tenenblatt | 5/419 X |
| 2,816,599 | 12/1957 | Adams | 190/8 X |
| 2,857,957 | 10/1958 | Gay | 5/420 X |
| 2,865,433 | 12/1958 | Warner | 190/8 X |
| 2,898,609 | 8/1959 | Storie | 5/419 |
| 4,164,275 | 8/1979 | Davis | 5/417 X |
| 4,194,601 | 3/1980 | Yellin | 190/8 X |
| 4,222,468 | 9/1980 | De Fries | 190/1 |
| 4,273,221 | 6/1981 | Poag | 190/1 X |
| 4,736,825 | 4/1988 | Belfi | 190/8 |
| 4,796,734 | 1/1989 | Distasio | 190/1 |

FOREIGN PATENT DOCUMENTS

| | | | |
|---|---|---|---|
| 6442465 | 3/1968 | Australia . | |
| 179613 | 9/1935 | Switzerland . | |
| 466083 | 5/1937 | United Kingdom | 190/1 |
| 1194851 | 6/1970 | United Kingdom | 190/8 |

*Primary Examiner*—Sue A. Weaver

*Attorney, Agent, or Firm*—Townsend and Townsend

[57] ABSTRACT

A beach bag has a flap with eyelets and a separate rectangular rest member having peripheral pegs which engage with the eyelets to permit the rest member to be used as a back rest or a neck rest. The bag contains a stiffening device comprising two L-shaped members rotatably arranged in a cross-member. With the ends of the L-shaped member inserted into respective pockets and/or tabs inside the bag, a firm and stable support is provided.

8 Claims, 2 Drawing Sheets

CONTAINERS, E.G. BEACH BAGS

The present invention relates to a container and more particularly to a bag e.g. a beach bag. With existing beach bags a separate blanket etc is required to place on the ground. Also existing bags are not sufficiently stiff for use as a back rest to lean against. The present invention seeks to overcome or reduce one or both of the above problems.

According to the present invention there is provided a container having a plurality of side walls characterised in that one of the side walls has an edge with a flap member secured thereto, said flap member being provided with first engagement means, the flap member in a first position being capable of being folded or rolled up against said side wall and, in a second position, being arranged to be extended from said edge of said side wall, and in that a rest member is provided which has second engagement means which are capable of engagement with said first engagement means whereby said rest member can be securely held in a position on said flap member and leaning against said side wall.

The container is preferably a bag, e.g. a beach bag, with four substantially rectangular side walls, a top wall and a bottom wall, said flap member extending from a long edge of one of the side walls at its junction with the bottom wall.

The rest member may be substantially rectangular and may be placed against the container with either a short edge or a long edge resting on the flap member on the ground, to form a back or neck support respectively. To enable a firmer support to be provided, said side wall of the bag may be provided with third engagement means which engage with further engagement means at the periphery of the rest member.

A preferred embodiment of the present invention will now be described, by way of example only, with reference to the accompanying drawings, of which:

Figure 1:
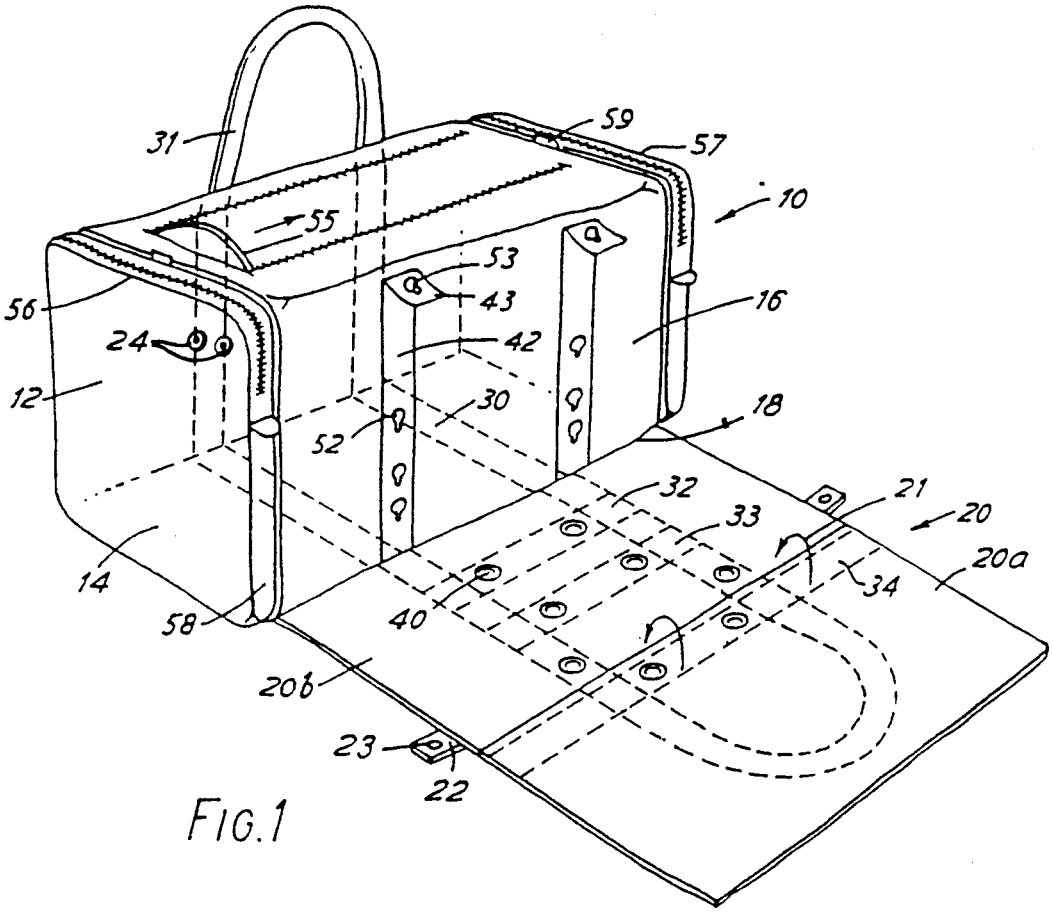
FIG. 1 is a front perspective view of the exterior of a beach bag in accordance with the present invention.
Figure 2:
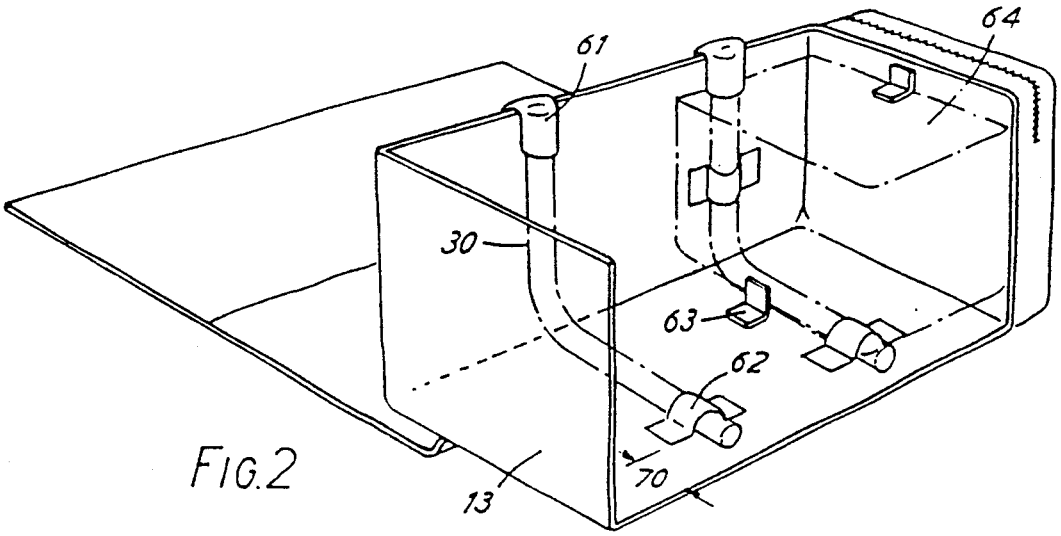
FIG. 2 is a partly cut-away perspective view showing the interior of the beach bag of FIG. 1.
Figure 3A:
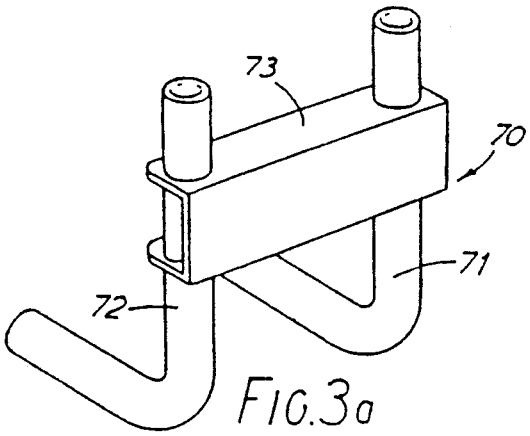
Figure 3B:
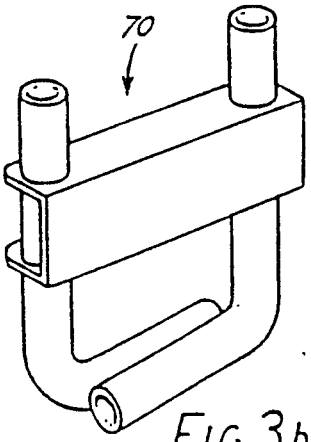
Figure 4:
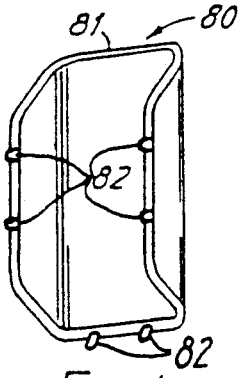
Figure 5:
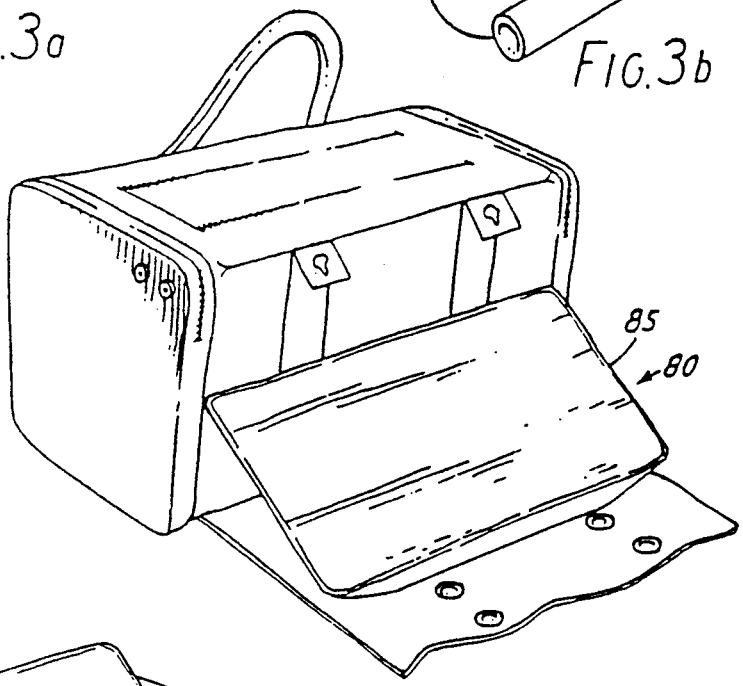
Figure 6:
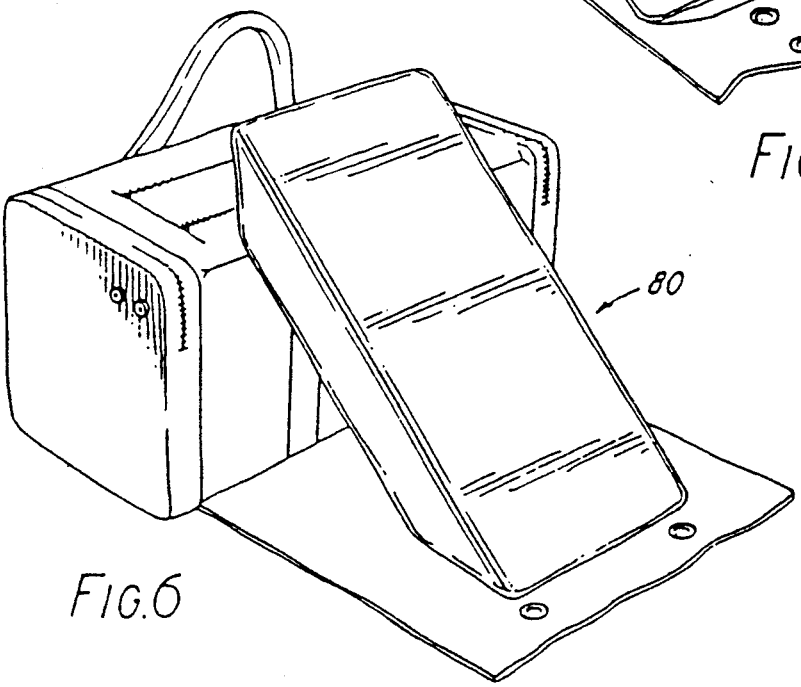

FIGS. 3*a* and 3*b* show views on the same scale as FIGS. 1 and 2 and on a reduced scale respectively of a reinforcing member for the beach bag;

FIG. 4 shows a perspective view on a reduced scale of a frame for a back rest member for use with the beach bag; and FIGS. 5 and 6 show alternative possibilities of use of the back rest member with the beach bag.

The Figs show a beach bag 10 having a front wall 16, top wall 11, end walls 12,13, and bottom wall 14. Secured to the beach bag at or adjacent to the bottom edge 18 of front wall 16 is a substantially rectangular flap or sheet member 20. The flap member comprises two portions 20*a*, 20*b* and when portion 20*a* is folded over portion 20*b* as indicated by arrows 21 in FIG. 1, the flap member may be folded-up flat against the front wall 16 and secured in this position by means of tabs 22 which have engagement means 23, e.g. press studs or touch-and-close material, which engage with corresponding means 24 on the end walls 12,13.

Secured, e.g. by stitching, to the material of the bag are webbing strips 30 which extend round the rear, bottom and front walls of the bag and continue upwards to meet in handle loops 31. Further transverse webbing strips 32,33,34 are similarly secured to the flap member.

A plurality of circular eyelets 40 extend through the flap member 20 and the webbing strips.

Further webbing strips 42 are secured to the front wall 16 of the bag and tabs 43 of webbing material extend from the top of the strips 42. Keyhole shaped eyelets 52, 53 are provided in each strip 42 and in each tab 43.

The bag 10 further comprises a top closure 55, side pouches or pockets 56,57 with internal divisions, and one or more corner tubular pockets 58 for receiving the pole of a parasol. Pockets 58 may contain a metal tube (not shown) for receiving the pole. Fittings, e.g. loops 59, are provided for the attachment of a shoulder strap.

Internally the bag is provided with pockets 61 and tabs or loops 62 which are located in line with the webbing strips 30 and may be conveniently of the same material. Further tabs 63 may also be provided for retaining a cooler box indicated in broken lines at 64.

A framework for the beach bag comprises two members, viz an internal stiffening member 70, FIG. 3, and a rest member frame 80, FIG. 4. The stiffening member comprises two substantially L-shaped tubes 71,72 of aluminium or mild steel mounted in a support 73. To stiffen the beach bag, the tubes are passed through loops 62 and the top ends of the tubes are inserted into pockets 61; thus the stiffening member is securely retained in the beach bag. For folding up substantially flat, the tubes can rotate within supports 73 as shown in FIG. 3*b*.

The frame 80 for the rest member is of tubular section 81 with a plurality of pegs or studs 82 around its periphery. A piece of canvas or other material 85 is stretched taut over the front and sides of the frame to complete the rest member. As shown in FIG. 5, the frame 80 may be placed on one of its long edges with selected ones of pegs 82 on one long edge engaging with an aligned pair of keyhole eyelets 52 selected for the angle of inclination desired. If desired, the pegs 82 may each be provided with a head, to avoid accidental slippage out of the keyhole apertures. Aligned pegs 82 in the other long edge of the frame 80 engage with a pair of selected eyelets 40 in the flap member. The rest member forms a secure neck rest in this configuration, with the head and neck of the user being kept clear of the tubular surround 81 which might cause discomfort.

As shown in FIG. 6, the frame 80 may be placed on one of its short edges with a selected pair of aligned pegs 82 on the long edges of the frame engaging in keyhole eyelets 43. Pegs 82 on the short edge of the frame 80 engage with a selected pair of aligned eyelets 40 in the flap member 20. The rest member thus constitutes a secure back rest. Again the body of the user does not rest against the tubular surround 81.

When the beach bag is being carried, the rest member, in view of its shape, can be conveniently located between the folded-up flap member 20 and the front wall 16.

An advantage of the above arrangement is that a single member can be used both as a neck rest and a back rest and in both cases slippage and collapse of the bag is prevented. In addition the rest member is easily carried on the outside of the bag, thus leaving the interior space free for carrying other articles. Moreover a single flap member is used both as a blanket and to secure the rest member. All the parts of the bag are collapsible so that it can be laid completely flat when not required, with the metal frame 70 inside the bag.

Since webbing strips 30 are integral with handles 31, they cradle the bag while it is being carried, thus avoiding strain on the connection between the strips and the bag.

Various modifications may be made to the above-described embodiment. For example the flap member 20 may be releasably secured to the bag; in this case, when not in use, it can be rolled up and attached to the exterior of the bag by further straps. The stiffening member 70 may be permanently incorporated in the bag if desired. Also, one or more pockets 58 may have an open bottom so that a parasol inserted in the pocket may project from the bottom thereof into the sand or ground so as to firmly anchor the beach bag and rest member. The rest member may have a cover of plastics material instead of canvas and may be a substantially flat padded member instead of the described frame.

Some or all of the illustrated eyelets may be omitted, even though such an arrangement may have less stability and less adjustability. In one preferred modification the side wall 16 of the bag has no eyelets and the flap 20 has just four eyelets arranged in a rectangle, i.e. two for engaging projections on the rest 80 in its FIG. 5 position and two for the FIG. 6 position. In this case the tubular section 81 has only four pegs, two on one of its short edges and two on one of its long edges. Rubber strips may be stitched along the edges of the bag and/or instead of webbing strips 30; such strips serve to reinforce the bag and to provide frictional resistance to slipping of the rest 80.

Support 73 may be replaced by a cross-bar which extends beyond the tubes 71, 72, the projecting ends of the cross-bar being accommodated in further pockets or tabs provided inside the bag.

I claim:

1. A container having a base for resting said container on a surface and a plurality of side walls, one of the side walls having an edge adjacent to said base, said edge having a flap member secured thereto, said flap member being provided with first engagement means and, capable of being folded or rolled up in a first position, against said side wall and, in a second position, when said flap is in use, being arranged to be extended horizontally from said edge of said side wall such that said flap is generally perpendicular to said side wall, and wherein a rest member is provided, said rest member having support means and second engagement means, said second engagement means being capable of engagement with said first engagement means, whereby in use said rest member can be securely held in a position on said flap member by said support means, such that said rest member leans against the exterior of said side wall, inclined at an acute angle to said flap and said side wall.

2. A container according to claim 1, wherein said rest member is substantially rectangular and comprises two long sides, two short sides, and at least two of said second engagement means, at least one of said second engagement means being on one of said long sides and at least one of said second means being on one of said short sides.

3. A container according to claim 1, wherein the side walls are provided with retaining means for retaining the foled up flap member against the outside of said side wall.

4. A container according to claim 1 comprising a plurality of walls, said walls comprising said plurality of side walls and said base and releasable means, wherein an adjacent pair of walls can be releasably held in a predetermined configuration by a stiffening member, said stiffening member comprising two L-shaped members and a cross member, said cross member having a plurality of apertures therethrough and being mounted on the inner surface of a first of said pair of walls and each of said L-shaped members including means for rotatably mounting said L-shaped members in said apertures in said cross-member, wherein both of said L-shaped members can be rotated from a first position wherein all parts of said L-shaped member are adjacent to said first wall, through substantially a right angle, to a second position where the L-shaped member partially abuts the second of said pair of walls, thereby holding said pair of walls in said predetermined configuration.

5. A container according to claim 4, wherein said side walls are provided with pockets for receiving the ends of said L-shaped member.

6. A container according to claim 4, wherein said side walls are provided with tabs for receiving the ends of said L-shaped members.

7. A container according to claim 1, further comprising an external pocket for receiving a pole, wherein the external pocket is arranged substantially vertically and is open at the bottom to permit said pole to extend beyond said base of said container.

8. A container for use as a beach bag comprising two side walls, a top wall, two end walls, and a base, all defining a plurality of walls, a flap member, a top closure, pockets, a stiffening member, and a rest member, one of said side walls having an edge adjacent to said base, said edge having a flap member secured thereto, said flap member being provided with first engagement means and, capable of being folded or rolled up in a first position against said side wall and, in a second position, when said flap is in use, being arranged to be extended horizontally from said edge of said side wall such that said flap is generally perpendicular to said side wall, said rest member having support means and second engagement means, said second engagement means being capable of engagement with said first engagement means, whereby in use said rest member can be securely held in a position on said flap member by said support means, such that said rest member leans against the exterior of said side wall inclined at an acute angle to said flap and said side wall, said rest member being substantially rectangular and comprising two long sides, two short sides, and at least two of said second engagement means, at least one of said second engagement means being on one of said long sides and at least one of said second means being on one of said short sides, wherein an adjacent pair of said plurality of walls can be held in a predetermined configuration by said stiffening member, said stiffening member comprising two L-shaped members and a cross member, said cross member having a plurality of apertures therethrough and being mounted on the inner surface of a first of said pair of walls, and each of said L-shaped members includes means for rotatably mounting said L-shaped members in said apertures in said cross-member, wherein both of said L-shaped members can be rotated from a first position wherein all parts of said L-shaped member are adjacent to said first wall, through substantially a right angle, to a second position where the L-shaped member partially abuts the second of said pair of walls, thereby holding said pair of walls in said predetermined configuration, wherein said side walls are provided with pockets for receiving the ends of the cross member, and further comprising an external pocket arranged substantially vertically and being open at the bottom to permit a pole to extend beyond the base of the container.

* * * * *